United States Patent [19]

Umiker

[11] Patent Number: 4,690,751

[45] Date of Patent: Sep. 1, 1987

[54] METHOD FOR SORTING OUT CERTAIN CONTAINERS, SUCH AS INDUSTRIAL CONTAINERS, BOTTLE CRATES ETC. FROM A STOCK OF CONTAINERS AND A DEVICE ON A CONTAINER FOR THE IDENTIFICATION OF A TO BE SORTED OUT CONTAINER

[75] Inventor: Hans Umiker, Zurich, Switzerland

[73] Assignee: Alexander Schoeller & Co. AG, Romont, Switzerland

[21] Appl. No.: 723,963

[22] PCT Filed: Aug. 7, 1984

[86] PCT No.: PCT/CH84/00124

§ 371 Date: Apr. 3, 1985

§ 102(e) Date: Apr. 3, 1985

[87] PCT Pub. No.: WO85/00763

PCT Pub. Date: Feb. 28, 1985

[30] Foreign Application Priority Data

Aug. 8, 1983 [CH] Switzerland ..... 4303/83

[51] Int. Cl.[4] ..... B07C 5/34

[52] U.S. Cl. ..... 209/3.3; 209/555; 209/583; 235/476; 235/489; 235/494

[58] Field of Search ..... 209/3.1–3.3, 209/523, 524, 547, 555, 583; 235/456, 458, 459, 461, 470, 475–477, 489, 490, 494, 385, 375; 198/349

[56] References Cited

U.S. PATENT DOCUMENTS

| | | | |
|---|---|---|---|
| 3,021,006 | 2/1962 | Beckman, Jr. | 209/3.3 |
| 3,033,367 | 5/1962 | Gumpertz | 209/3.3 |
| 3,169,874 | 2/1965 | Birchall | 209/3.3 X |
| 3,645,391 | 2/1972 | Hirakawa et al. | 209/3.3 |
| 3,663,802 | 5/1972 | Wildhaber | 235/494 |
| 3,745,314 | 7/1973 | Mathias et al. | 209/523 X |
| 3,803,556 | 4/1974 | Duffy | 198/349 X |
| 3,923,158 | 12/1975 | Fornaa | 209/555 X |
| 4,109,511 | 8/1978 | Powers, Jr. et al. | 209/538 X |
| 4,166,673 | 9/1979 | Dona | 209/583 X |
| 4,230,266 | 10/1980 | Juvinall | 235/490 |
| 4,248,389 | 2/1981 | Thompson et al. | 209/538 X |
| 4,285,426 | 8/1981 | Cahill | 194/209 |
| 4,349,731 | 9/1982 | Berner | 235/489 |
| 4,454,413 | 6/1984 | Morton, Jr. | 235/456 X |
| 4,558,212 | 12/1985 | Hampson | 235/385 X |

FOREIGN PATENT DOCUMENTS

| | | | |
|---|---|---|---|
| EP65302 | 11/1982 | European Pat. Off. . | |
| 2907265 | 8/1980 | Fed. Rep. of Germany . | |
| 3008745 | 9/1981 | Fed. Rep. of Germany . | |
| 2005885 | 4/1979 | United Kingdom | 209/524 |

OTHER PUBLICATIONS

"*Alphanumeric Bar Code*", IBM Technical Disclosure Bulletin, vol. 22, No. 8B, Shine et al., Jan. 1980.

*Primary Examiner*—Robert B. Reeves
*Assistant Examiner*—Edward M. Wacyra
*Attorney, Agent, or Firm*—Bachman & LaPointe

[57] ABSTRACT

Containers, e.g. bottle crates, industrial containers, of a common issue (Fxx1), e.g. a manufacturing series, are provided with a specific marking which indicates that they belong together. The mixing up of the various issues (Fxx1 . . . Fyz1 . . . Fzz2) which occurs during the circulation (Z, RZ) can again be reversed in an automatic sorting process, which makes it possible to sort out a desired sub-quantity (Fxx1) and to subject same to a further process stage (Rxx1, Axx1). The marked containers display an optically readable marking (3, 4), from which the information for the automatic sorting out of an issue can be noted.

7 Claims, 4 Drawing Figures

Figure 1:
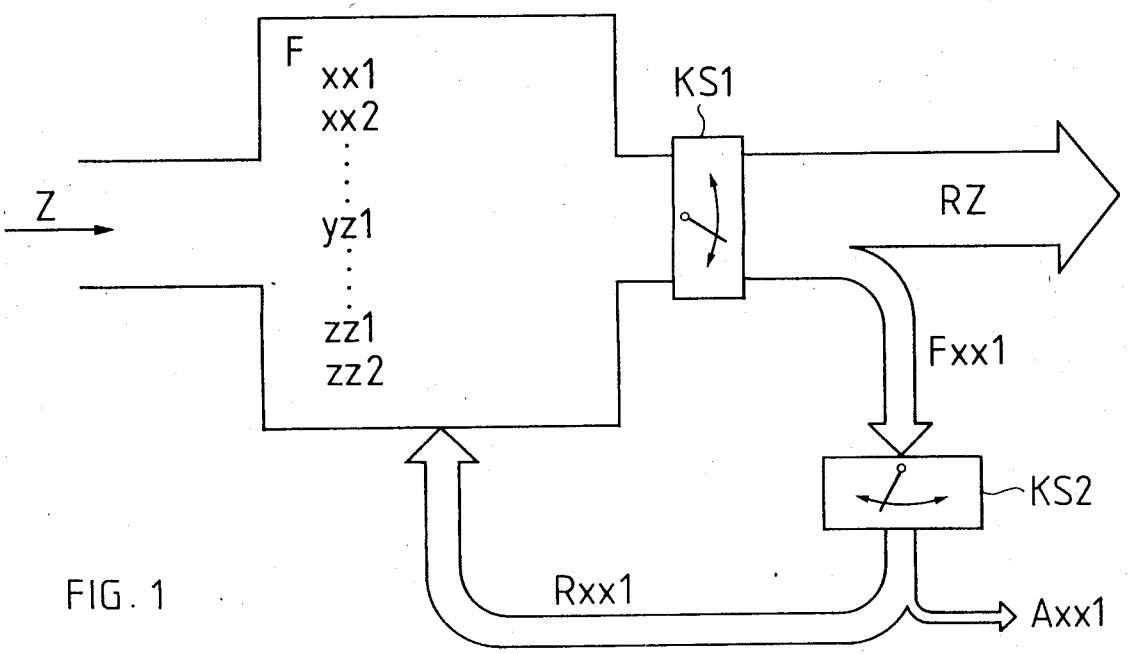

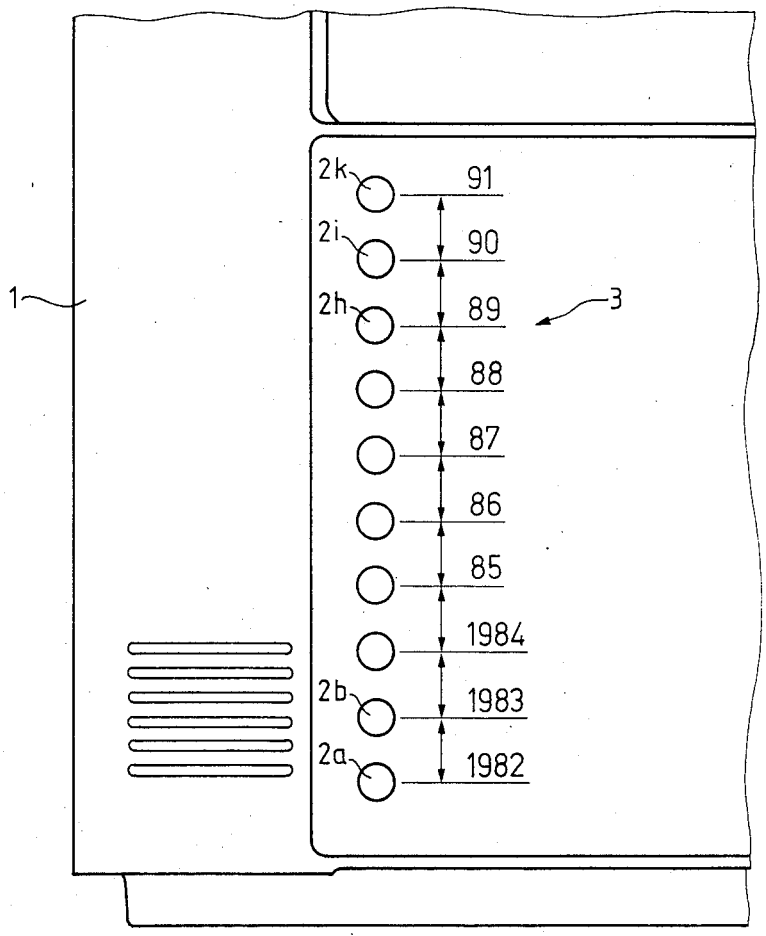
FIG. 2
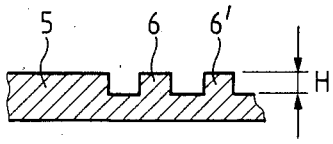
FIG. 3
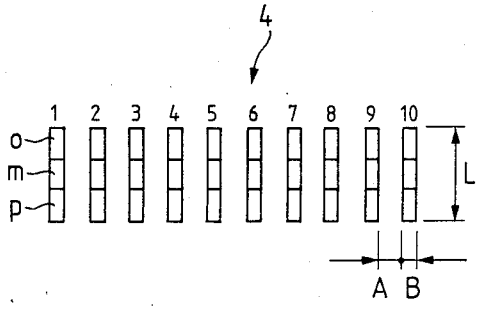

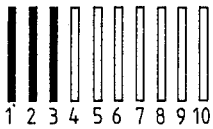
GR A
FIG. 4
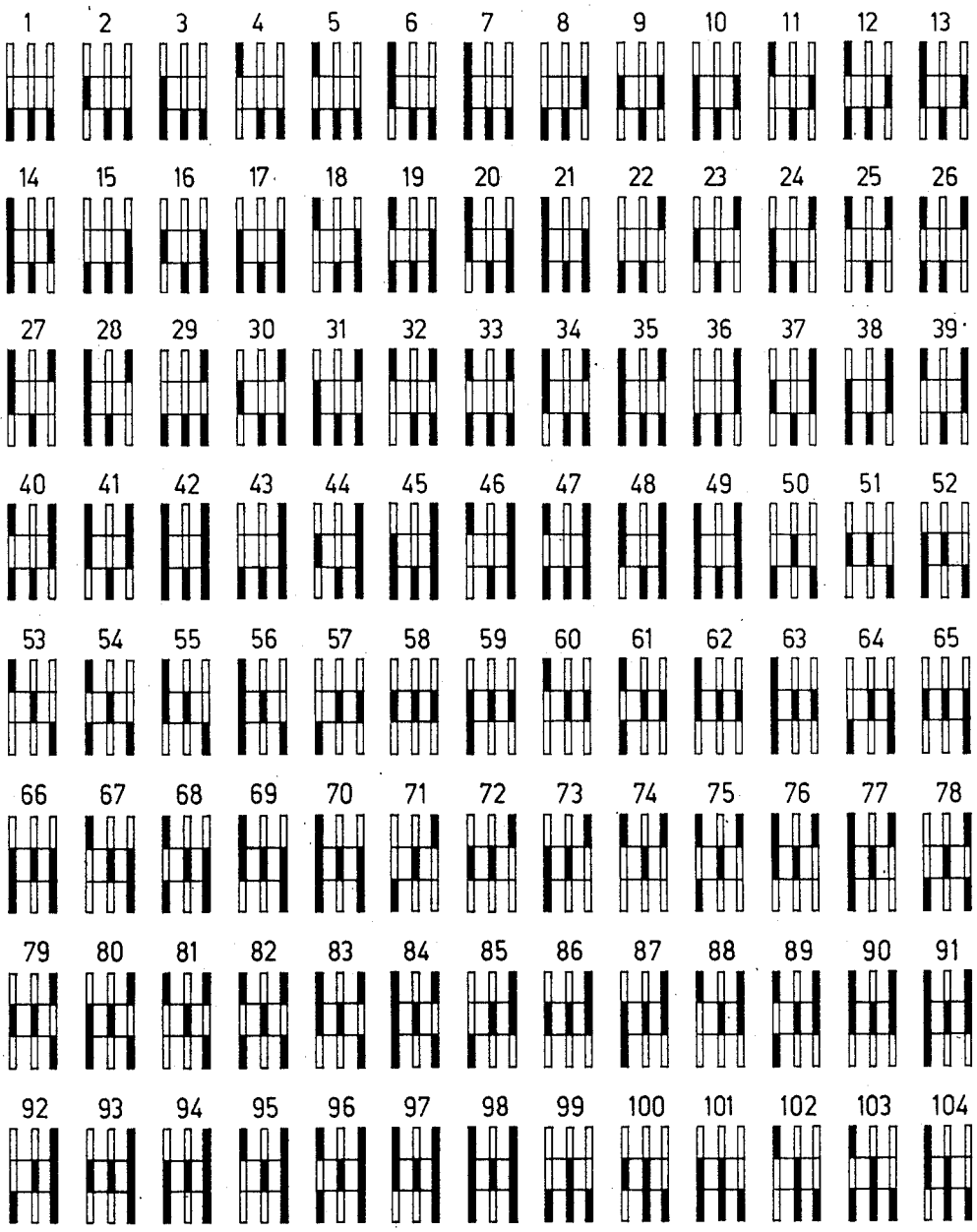

METHOD FOR SORTING OUT CERTAIN CONTAINERS, SUCH AS INDUSTRIAL CONTAINERS, BOTTLE CRATES ETC. FROM A STOCK OF CONTAINERS AND A DEVICE ON A CONTAINER FOR THE IDENTIFICATION OF A TO BE SORTED OUT CONTAINER

The invention lies in the field of the transport of piece goods and relates to a method for sorting out certain containers, such as industrial containers, bottle crates etc., from a stock of containers and to a device on a container for the identification of a to be sorted out container whereby containers from a stock of containers are sorted out by means of optical detection characterized in that the containers of a common issue are provided with a specific marking from which it can be noted that they belong together, in that after being mixed up during use the containers of a common issue are again brought together and in that the sorted quantity of a common issue is eliminated from the overall quantity.

Bottle crates as containers for a certain number of bottles, belong to the type of re-usable containers, the circulation factor of which, ie. the number of re-utilizations, may assume quite high values. At an average circulation time of 5 days and an average service life of a plastic bottle crate of 8 years, an average circulation factor of close on 600 can be expected. This relates in an idealised manner to one item and its service life, during which these circulations naturally do not take place in a uniform manner, ie. seen on a time axis shorter and longer cycles are the cause of an inhomogeneous distribution. If, for example, a total of 1000 crates is brought into circulation at the same time, the initially sequenced quantity very quickly comes out of sequence, so that already in the first third of the average life of a crate one can expect a broad distribution of the individual circulation factors in accordance with the laws on statistics.

An additional problem is created by the requirement that a container, eg. a bottle crate, should not be used after it is damaged and also not after it presents a shabby appearance. Such bottle crates must be removed from circulation in good time. Furthermore, one must still take into account the remarkably high number of bottle crates of a stock of bottle crates, which may easily run into millions. Together with the dropping out of sequence within individual issues of new bottle crates during the circulation and the dropping out of sequence of the various issues amongst one another, there would result in time an intimately mixed stock of recent bottle crates which, however, due to many circulations have aged quickly, and old bottle crates which because of a gentle treatment have remained intact. There also often occur defective series of any type and quantity. Thus, in the case of bottle crates for example, it is important that one is able to eliminate certain defective series, the defectiveness relating mainly to a lack of mechanical stability, seeing that this type of transport containers may be stacked very high and such defective items may cause such a stacking system to collapse. However, to keep such an overall stock to a certain degree in a usable condition by a sorting out of battered, defective and unsatisfactory bottle crates, requires a lot of work and is quite costly.

Nevertheless, more and more breweries, for example, intend to sort out their stock of bottle crates and to eliminate aged bottle crates. This also applies, however, to other branches where the stock of containers reaches considerable numbers.

It is the aim of the invention to indicate a method by which the sorting out of aged and/or defective containers, as well as of containers which at an early stage are recognised as having been made defectively, eg. industrial containers, bottle crates, etc., from a stock of containers of any size, ie. from any quantity, can take place in the shortest possible time and in an economical manner.

It is furthermore the aim of the invention to create, with a view to such large numbers of items, an as economical as possible device by which the method for the sorting out can be performed.

Furthermore it is the aim of the invention to design the device in such a manner that the conventional and to some extent already existing means for the sorting out can be used.

The aim is achieved by the invention whereby containers of a common issue are provided with a specific marking from which it can be noted that they belong together, in that after being mixed up during use the containers of a common issue are again brought together, and in that the sorted quantity of a common issue is eliminated from the overall quantity.

The invention will now be discussed in detail with the aid of the following figures, using the example of a stock of bottle crates used by the wholesale producers of drinks. Shown are:

FIG. 1 a diagrammatic representation of the method according to the invention;

FIG. 2 a first embodiment of the device according to the invention on a bottle crate;

FIG. 3 a second preferred embodiment of the device on a container, which may be a bottle crate or an industrial container, and FIG. 4 a code arrangement of the embodiment according to FIG. 3.

In principle there exist two possibilities for sorting out defective, damaged, too old or shabby looking bottle crates: the systematic sorting out, with which after going through the entire stock practically all the to be eliminated items are removed, or also the sporadic sorting out with which the items, which by a natural random process arrive at an existing check point or check points, are removed from the overall stock.

The systematic method undoubtedly entails costs which in the case of smaller quantities to be checked increase linearly with the size of the quantity, and in the case of larger quantities in a proportion which is no longer linear to the size of the quantity. The stock of bottle crates of an average brewery will be of a magnitude at which the costs for the sorting out increase superproportionally.

With the sporadic sorting out, the quality of the sorting out depends on how long it takes before the entire stock has passed the check point or check points once. In the case of very large quantities, ie. several hundreds of thousands of bottle crates, such a cycle may exceed the average service life of a bottle crate, ie. there occur more bottle crates that should be eliminated than are eliminated, as a result of which the overall stock becomes, of course, successively older and older. However, if in order to also remedy this a larger number of check points are provided so as to increase the throughflow, or in order to reduce the time of the checking cycle in such a way that it lies well below the average service life of a bottle crate, this soon results in an unprofitable amount of work, in which connection it should then be considered whether at practically the same amount of work one should not prefer a systematic checking as described above.

The systematic checking undoubtedly provides better results, but is always expensive and, a point which should not be overlooked if the result is not to be endangered, a predetermined minimum amount of work is unavoidable. In other words, in contrast to the above throughflow-and-random method, the sorting effort cannot be varied at will; below a certain minimum amount of work, which depends on the quantity to be checked, the result collapses.

The method according to the invention aims at assisting the systematic sorting out and at minimising the work required for this, which should directly result in a greater economy. The device according to the invention makes it possible to perform the method within and with the existing means. If the firms in question did not until now ensure a continuous renewal of their stock of bottle crates, this is due to the fact that as yet no method was known which is efficient and at the same time also profitable.

It is a characteristic of the method to provide a specific marking on the individual issues of the bottle crates in such a manner that by means of an optical mechanical process bottle crates of the same issue can automatically be combined into a sub-quantity and separated from the overall stock of bottle crates. A special issue relates amongst others to product series which may display fundamental defects: thus with one series the UV-stablilisation of the plastic may be insufficient, with another series the manufacturing and starting material may be bad, with still another series the pigmentation is not satisfactory, or with another series certain production data were selected incorrectly etc. Generally such defects are not ascertained immediately, but become noticeable only after the item displaying such inherent defects has been in use for some time, ie. they can only be detected by the usual means, which mostly are visual checks. The diagrammatic representation in FIG. 1 shows a stock of bottle crates F of any size with the number of items split into the groups marked Fxx1, Fxx2 . . . Fyz1 . . . Fzz1, Fzz2. From the circulation flow Z the returned bottle crates go into the stock, which here is shown as a buffer or reservoir. The items of the differently marked groups are completely mixed up and when required must again be combined into the original groups. This is ensured by a check point KS1, which arranged at a suitable point sorts out, for example, the items of a group Fxx1 which display a manufacturing defect. Suitable points are, for example, internal circulations as occur during the filling, cleaning etc. The items which do not belong to a sorted group go back into the recirculation RZ.

The separated group Fxx1 can be dealt with in two ways. If one assumes that at an approximately identical wear load an entire issue has for the greater part come to the end of the defined service life, the still usable crates of a group Rxx1 can, for example, be sorted out by hand or, if in view of the small quantity this is not worth it, the entire "issue" can be eliminated. The assessment whether a bottle crate can still be used and for how long it can still be used in this state, can probably only be entrusted to a person with the right experience. This is where a further characteristic of the invention comes to the fore, this time with regard to the device for performing the method; if a bottle crate is still found suitable, it should be possible to allocate it to another, ie. more recent group.

As mentioned in the foregoing, the sorted group Fxx1, if not thrown out at the first check point, can at a second check point KS2 be split into still usable items of a group Rxx1 and into unsuitable, to be eliminated items of a group Axx1. As already mentioned, the criterion of a second check is an economic criterion, seeing that this checking operation has to be carried out by people.

The fastest and possibly also the most economical manner would be the sorting out of a group, the items of which are for the greater part rated as having become unsuitable, in which connection the "unsuitability" is indicated by a statistical distribution. If this distribution is relatively wide, then it will be worthwhile to re-check the group, returning the still suitable items to more recent groups, eg. Rxx1 to Fxx2. In this connection it must be possible to change the marking that identifies the group.

FIG. 2 now shows an embodiment of the device according to the invention for performing the method described in the foregoing. On a bottle crate 1, of which only part is illustrated, one notes a marking which consists of a series of holes 2*a*, 2*b* . . . 2*k* positioned above one another. Every hole corresponds to a certain height and an issue related thereto. The marking is arranged, for example, on the narrow sides of the bottle crates so that it can be read properly, irrespective of the working position. On the belt conveyor two positions are possible so that the same marking is provided once again diagonally offset on the second narrow side of the bottle crate. The marking forms an integral part of the crate, and when producing the crate it is provided thereon, eg. by means of an injection moulding operation. In this manner the year of manufacture of a crate can easily be detected optically by means of a simple, height-adjustable photocell device, and the crate can be sorted out accordingly. If a bottle crate is to be allocated to a more recent year of manufacture, it is given one more hole if provision is made that the number of holes increases with the years of manufacture.

FIG. 3 shows a second considerably different embodiment of the device according to the invention, which also comprises an optically readable marking 4 stamped into the bottle crate or into the material 5 thereof, which marking 4 consists of a plurality of web-like raised parts 6, 6', etc. Each individual web of the length L is divided into 3 sections of the same size o, m and p, so that a single marking bar is able to indicate six conditions seeing that the web height H can be stepped down in thirds. In this way two webs can indicate 36 conditions and n webs 6 to the power of n conditions. Sufficient possibilities to store, in addition to the age of the bottle crate, also other information, eg. the material, pigment, origin and other fine-grain data. Since it is possible to take down the web purely materially, the codings can for organisation purposes be provided in such a way that, for example, by a grinding down or solely by an optical changing of a web part o, m, p, re-dating can be achieved. For bottle crates which are to be sorted out, the additional information serves as an organisational means for the re-acquisition. Because of this coding it now is possible to remove defective series as described above, eg. 2000 pieces, also from of a stock which comprises millions of items, and to eliminate them without the need of, basically from a statistical point of view, less effective but nevertheless complicated and expensive visual checks by people. How important it may be to remove certain defective issues from the stock, has already been indicated at the outset.

The reading of the marking integrated in the bottle crate material takes place by optical means, which either are already available or are also easily obtainable on the market. The embodiment discussed here is extremely suitable for a computerised detection and control. A normal dimensioning of the marking is, for example, as follows:

Length of a marking bar: L=20 mm
Height of the stamping: H=1 mm
Width of a marking bar: B=1.5 mm
Distance between marking bars: A=2.5 mm The following is an example for the organisation of the marking bars on the bottle crate and the data related thereto:

Group A: injection mould number and crate type bars 1+2+3
Group B: year or date of manufacture bars 4+5
Group C: raw material and guarantee data bars 6+7
Group D: ownership details of the crate bars 8+9
Group E: production/manufacturer a.o. bar 10

Such groupings are, of course, optional and can be chosen and arranged at will in accordance with the requirements. It also is not necessary to select 10 marking webs 6; in view of the relatively high data density, fewer webs will generally suffice. However, when computers are used, it is advantageous that the maximum data density is not fully utilised, seeing that the re-dating becomes increasingly difficult, the greater the utilisation.

FIG. 4 shows a section of all that can be obtained with only three marking webs. By way of example these codes are allocated to the group A, which furnishes information on the injection mould and the crate type. If a redating is necessary, the codes of this group are not involved, but only the codes of group B, which furnishes information on the date of manufacture. In the case of a re-dating a third part of the web o, m, p is taken down, which in the illustration of FIG. 4 would then correspond to the white parts of the bars.

As intended by the invention, the marking 3 of the first embodiment and the marking 4 of the second embodiment form an integral part of the bottle crate, ie. it is incorporated in the material thereof so that it cannot get lost. With the first embodiment the marking consists of simple holes, which can also still be produced at a later date, and which need not necessarily be round, ie. in the form of drill-holes. Advantageously, however, every "year of manufacture"—with these means it is after all only possible to indicate the year—is stamped in during the manufacture, and an additional perforation is used only for the re-dating. In this manner the desired economy is ensured. With the second, far more differentiated embodiment, the multibar-marking must at any rate be produced during the manufacture of the bottle crate. To this end the mould is provided with a simple stamping insert with the necessary information, the depth H of the stamping being provided in such a way that at least with regard to time it is forward-compatible by a taking down of web sections.

Summarising once again, the invention consists of a method for sorting out certain containers, eg. bottle crates, industrial containers, from a stock of containers by means of optical detection, characterised in that the containers of a common issue are given a specific marking so that they can be recognised as belonging together, in that after being mixed up during use the containers of a common issue are again brought together, and in that the items of a common issue that have been brought together are eliminated from the overall stock. Furthermore, in that the marking is detected optically and the decision mechanism is controlled with the gathered information, so that the items of a sub-quantity recognised as belonging together are sorted out from an overall quantity, and in that the sorted quantity is checked during a further stage of the process so as to detect containers that can be used again, and these are re-allocated to a more reccent issue.

Furthermore, before returning items of a sorted-out sub-quantity to the overall quantity, the marking can be changed.

The invention also consists of a device on a container for the identification of a container to be sorted out in order to perform the method described above, and is characterised in that every container bears a marking (3, 4) of the own characteristics, and this marking contains information of the containers; the information stored in the marking contains data on the manufacture and/or manufacturer of the container, the marking (3, 4) being stamped into the material of the container as an integral part of the container during the manufacture thereof, and the marking can be changed with regard to the information.

The device is furthermore characterised in that the integrated marking (3, 4) can be changed from a marking (3) indicating an older date of manufacture (2*a*) to a marking indicating a more recent date of manufacture (2*b*). Also in that the marking consists of a series of optically readable perforations in the material of the container (2*a*).

The marking (4) also consists of a plurality of optically readable web-like raised parts (6, 6') in the surface of the container and may be a multibar marking (FIG. 4), in which case a marking bar (6, 6') comprises at least two height stages (H) in halves (o, m) or three or more height stages (H) in thirds (o, m, p), etc.

I claim:

1. Method for sorting out containers, such as bottle crates and industrial containers, from a stock of containers by means of optical detection, which comprises: providing a stock of containers with specific markings from which it can be noted if they belong to a common issue, whereby after being mixed up during use the containers of a common issue are brought together; optically detecting said markings; separating containers from said stock based on the optical detection of containers belonging to a common issue; further checking the separated containers at a further processing stage for reuseable containers; and returning said reuseable containers to a more recent common issue, wherein the marking is changed before returning separated items to said more recent common issue.

2. Device for the identification of a container, such as bottle crates and industrial containers, to be sorted out from a stock of containers by means of optical detection, which comprises a stock of containers with specific optically detectable markings from which it can be noted if they belong to a common issue whereby after being mixed up during use the containers of a common issue are brought together, characterized in that each container bears a marking identifying characteristics of the container wherein said marking is stamped into the material of the container as an integral part thereof during the manufacture thereof and the marking is such that it can be changed with regard to the information therein from a marking indicating an older date of manufacture to a marking indicating a more recent date of manufacture.

3. Device according to claim 2 wherein the marking consists of a series of optically readable perforations in the material of the container.

4. Device according to claim 2 wherein the marking consists of a plurality of optically readable, web-like raised parts in the surface of the container.

5. Device according to claim 4 wherein the marking is a multibar marking.

6. Device according to claim 5 wherein a marking bar comprises at least two height stages.

7. Device according to claim 5 wherein a marking bar comprises at least 3 height stages.

* * * * *